US011199033B2

(12) United States Patent
Yi et al.

(10) Patent No.: US 11,199,033 B2
(45) Date of Patent: Dec. 14, 2021

(54) REFRIGERATOR

(71) Applicant: LG ELECTRONICS INC., Seoul (KR)

(72) Inventors: Myeongha Yi, Seoul (KR); Nami Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 269 days.

(21) Appl. No.: 15/310,037

(22) PCT Filed: Sep. 7, 2016

(86) PCT No.: PCT/KR2016/010023
§ 371 (c)(1),
(2) Date: Nov. 9, 2016

(87) PCT Pub. No.: WO2017/043861
PCT Pub. Date: Mar. 16, 2017

(65) Prior Publication Data

US 2018/0179792 A1 Jun. 28, 2018

(30) Foreign Application Priority Data

Sep. 11, 2015 (KR) ..... 10-2015-0129110

(51) Int. Cl.
*E05C 1/00* (2006.01)
*F25D 23/02* (2006.01)
(Continued)

(52) U.S. Cl.
CPC ..... *E05C 1/006* (2013.01); *E05B 65/00* (2013.01); *E05C 1/02* (2013.01); *E06B 3/36* (2013.01);
(Continued)

(58) Field of Classification Search
CPC .. F25D 23/02; F25D 23/028; F25D 2323/023; F25D 2323/02; E05C 1/006;
(Continued)

(56) References Cited

U.S. PATENT DOCUMENTS 8,424,985 B2 * 4/2013 Kwon ..... F25D 23/02 312/405
2013/0169138 A1 * 7/2013 Im ..... F25D 23/028 312/404
(Continued)

FOREIGN PATENT DOCUMENTS

CN 102947657 2/2013
CN 104019597 9/2014
(Continued)

OTHER PUBLICATIONS

Translation of KR20150098915A, 7 pages (Year: 2015).*
(Continued)

*Primary Examiner* — Andrew M Roersma
(74) *Attorney, Agent, or Firm* — Fish & Richardson P.C.

(57) ABSTRACT

Disclosed is a refrigerator, more particularly a refrigerator including dual doors that are convenient to use. The refrigerator includes a main body having a storage space therein, a first door hinged to the main body for opening and closing the storage space, a door frame provided at the first door, a second door hinged to the first door, the second door having a side wall, at least a portion of which is inserted into the door frame, and a catching part provided in the side wall, and a locking device for selectively allowing the second door to be turned with respect to the first door, wherein the
(Continued)

locking device includes a moving member, the displacement of which is changed depending on the open or closed state of the first door, and a catching member, the displacement of which is changed depending on the displacement of the moving member, whereby the protruding length of the catching member from the door frame is changed, the catching member being selectively caught in the catching part.

20 Claims, 7 Drawing Sheets

(51) Int. Cl.

| | |
|---|---|
| ***E05B 65/00*** | (2006.01) |
| ***E05C 1/02*** | (2006.01) |
| ***E06B 3/36*** | (2006.01) |
| ***E06B 5/00*** | (2006.01) |

(52) U.S. Cl.
CPC ..... *E06B 5/00* (2013.01); *F25D 23/02* (2013.01); *F25D 23/028* (2013.01); *E05Y 2600/46* (2013.01); *E05Y 2800/71* (2013.01); *E05Y 2900/31* (2013.01)

(58) Field of Classification Search
CPC ... E05C 1/02; E05Y 2900/31; E05Y 2600/46; E05Y 2800/71; E06B 3/36; E06B 5/00
See application file for complete search history.

(56) References Cited

U.S. PATENT DOCUMENTS

| | | | | |
|---|---|---|---|---|
| 2014/0232250 | A1* | 8/2014 | Kim | F25D 23/028 312/292 |
| 2014/0232251 | A1* | 8/2014 | Kim | F25D 23/028 312/404 |
| 2015/0069900 | A1* | 3/2015 | Lim | F25D 23/028 312/405 |
| 2015/0137674 | A1* | 5/2015 | Choi | F25D 23/04 312/404 |

FOREIGN PATENT DOCUMENTS

| | | | | |
|---|---|---|---|---|
| EP | 2610566 | A2 * | 7/2013 | F25D 23/028 |
| JP | S63-142682 | | 9/1988 | |
| JP | H02247479 | A * | 10/1990 | F25D 2323/023 |
| JP | H109757 | A * | 1/1998 | F25D 2323/023 |
| JP | 2003302150 | A * | 10/2003 | |
| KR | 20-0184602 | | 6/2000 | |
| KR | 1020070015337 | | 2/2007 | |
| KR | 2020090004606 | | 5/2009 | |
| KR | 10-2011-0007369 | | 1/2011 | |
| KR | 10-2015-0098915 | | 8/2015 | |
| KR | 10-2015-0102417 | | 9/2015 | |

OTHER PUBLICATIONS

Extended European Search Report in European Application No. 19150554.4, dated Apr. 18, 2019, 7 pages.
Chinese Office Action in Chinese Application No. 201680027318.6, dated Jun. 3, 2019, 17 pages (with English translation).

* cited by examiner

REFRIGERATOR

CROSS REFERENCE TO RELATED APPLICATIONS

This application is a U.S. National Phase Application under 35 U.S.C. § 371 of International Application PCT/KR2016/010023, filed on Sep. 7, 2016, which claims the benefit of Korean Application No. 10-2015-0129110, filed on Sep. 11, 2015, the entire contents of which are hereby incorporated by reference in their entireties.

TECHNICAL FIELD

The present invention relates to a refrigerator, and more particularly, to a refrigerator including dual doors that are convenient to use.

BACKGROUND ART

In general, a refrigerator is an apparatus that discharges cool air generated by a refrigerating cycle involving a compressor, a condenser, an expansion valve, and an evaporator to lower the temperature in the refrigerator such that food is stored in a frozen state or in a refrigerated state.

A refrigerator generally includes a freezing compartment for storing food or beverages in a frozen state and a refrigerating compartment for storing food or beverages in a refrigerated state.

Refrigerators are classified into a top mount type refrigerator, in which a freezing compartment is disposed above a refrigerating compartment, a bottom freezer type refrigerator, in which a freezing compartment is disposed under a refrigerating compartment, or a side by side type refrigerator, in which a freezing compartment and a refrigerating compartment are disposed side by side. In all cases, doors are provided at the freezing compartment and the refrigerating compartment such that access to the freezing compartment and the refrigerating compartment is possible through the doors.

In addition to refrigerators in which a freezing compartment and a refrigerating compartment are partitioned from each other, there are also refrigerators in which access to a freezing compartment and a refrigerating compartment is possible through a single door. Most such single door type refrigerators are small-sized, and the freezing compartment is generally provided in a specific space inside the refrigerating compartment.

In addition, there is a French type refrigerator, in which an upper refrigerating compartment is opened and closed by left and right doors, as a kind of top mount type refrigerator. A freezing compartment of the French type refrigerator may also be opened and closed by left and right doors.

In recent years, the functions of the refrigerator have been diversified in addition to the original functions of the refrigerator, including storage of food in a frozen state or in a refrigerated state. For example, a dispenser may be mounted in the door of the refrigerator to provide clean water and ice, or a display unit may be mounted to the front of the door to display the state of the refrigerator such that the refrigerator can be appropriately controlled.

In recent years, a refrigerator configured such that a portion of the storage compartment is opened has been proposed. That is, a refrigerator having a sub door for opening and closing a sub storage compartment provided in a main door has been proposed. The sub storage compartment is a portion of a main storage compartment. At least a portion of the sub storage compartment may be partitioned from the main storage compartment by a partition wall. The sub storage compartment may be provided in front of the main storage compartment. This type of refrigerator may be called a door in door (DID) refrigerator. When the sub door is opened, the leakage of cool air from the main storage compartment is somewhat reduced, thereby achieving an energy saving effect.

For example, goods that are frequently used, such as beverages, may be stored in the sub storage compartment. The sub door may be opened to access the sub storage compartment without opening the main door.

FIG. 1 is a view showing an example of a conventional DID refrigerator or a conventional dual-door refrigerator.

The refrigerator shown is a bottom freezer type refrigerator, in which a refrigerating compartment is provided in the upper part of a main body 10 and a freezing compartment is provided in the lower part of the main body. The refrigerating compartment and the freezing compartment may be portions of a storage compartment or a main storage compartment 11 provided in the main body 10.

In the example shown, a left refrigerating compartment door 20 and a right refrigerating compartment door 25 for opening and closing the refrigerating compartment are respectively hinged to the left and right sides of the main body 10.

A left freezing compartment door 30 and a right freezing compartment door 40 may be respectively hinged to the left and right sides of the lower part of the main body 10 such that the left freezing compartment door and the right freezing compartment door are respectively provided under the left refrigerating compartment door and the right refrigerating compartment door. Alternatively, a single freezing compartment door may be hinged to the main body, or may be a drawer type door, which is separably mounted in the main body in the forward-rearward direction.

A handle groove 32 may be provided in the top surface of the left freezing compartment door 30, and a handle groove may also be provided in the top surface of the right freezing compartment door 40.

As shown in FIG. 1, the right refrigerating compartment door 25 may include a main door 100 mounted to one side of the main body 10 so as to be turned about a main door hinge 110 and a sub door 200 mounted to the main door 100 or the main body 10 so as to be turned about a sub door hinge 130. That is, both the main door 100 and the sub door 200 may be opened to access the refrigerating compartment.

An opening may be provided in the inner middle part of the main door 100, and a sub storage compartment (not shown) may be provided at the rear of the main door 100.

The sub door 200 may be opened to access the sub storage compartment through the opening in the main door 100. That is, only the sub door 200 may be opened to access the sub storage compartment without opening the main door 100.

As shown, in the conventional DID refrigerator or the conventional dual-door refrigerator, the main door 100 and the sub door 200 overlap each other. That is, the sub door 200 covers the front of the main door 100. The area of the front of the main door 100 may be substantially equal to that of the sub door 200.

The above refrigerator may be used as follows. First, both the main door 100 and the sub door 200 are opened to use the main storage compartment 11. Second, only the sub door 200 is opened to use the sub storage compartment.

When closing the main door 100 in the state in which both the main door 100 and the sub door 200 are open, however, the main door 100 and the sub door 200 may be separated from each other due to inertia.

That is, when a user slams the main door 100 in the state in which both the main door 100 and the sub door 200 are open, the sub door 200 may be separated from the main door 100, as shown in FIG. 1.

In general, a user moves out of the opening path of the door when the user opens the door 100. In addition, the user moves toward the main body of the refrigerator when the user closes the door 100. If the door does not close when the user moves toward the main body of the refrigerator while closing the door, the user may collide with the door.

In particular, in the case in which the turning paths and the turning radii of the main door 100 and the sub door 200 are substantially the same, as shown in FIG. 1, the user may frequently collide with the sub door 200 if only the main door 100 is closed and the sub door 200 remains open.

In order to solve this problems, a locking device may be provided to lock the main door 100 and the sub door 200 such that the sub door 200 is separated from the main door 100 only in the state in which the main door 100 is closed and such that the sub door 200 is not separated from the main door 100 only in the state in which the main door 100 is open.

However, it is not easy to provide such a locking device due to the characteristics of the door of the refrigerator. The reason for this is that the door is provided at the front of the refrigerator, whereby the design of the refrigerator is defined by the door. Consequently, it is not desirable to expose the locking device out of the refrigerator in terms of design. In addition, an additional space may be needed to expose the locking device outward, and the locking device may not be properly operated due to external impact or external objects.

Meanwhile, the door of the refrigerator functions as a heat insulation wall for preventing the discharge of cool air. For this reason, it is necessary to prevent deterioration of the heat insulation function attributable to the locking device.

Therefore, there is a necessity for providing a DID refrigerator or a dual-door refrigerator that is capable of satisfying the design of the refrigerator, the function of a door as a heat insulation wall, the reliability of a locking device, and reliable cooperation of the locking device with the door.

DISCLOSURE

Technical Problem

A fundamental object of the present invention is to solve the above problems.

An embodiment of the present invention provides a refrigerator that is capable of preventing a second door from being separated from a first door due to inertia. In particular, an embodiment of the present invention provides a refrigerator that is capable of preventing a second door from being separated from a first door when the first door is closed.

An embodiment of the present invention provides a refrigerator that is capable of preventing the deterioration in design of the refrigerator due to a locking device, thereby providing an aesthetically pleasing appearance. In particular, an embodiment of the present invention provides a refrigerator configured such that a locking device and the operation of the locking device are outside of the visual field of a user, thereby providing a safe and aesthetically pleasing appearance.

An embodiment of the present invention provides a refrigerator that is capable of enabling the closed state and the open state of a first door to be easily structurally checked, whereby the construction of a locking device is very simple and the reliability of the locking device is guaranteed.

An embodiment of the present invention provides a refrigerator that is capable of minimizing the deterioration in the heat insulation function of a first door and a second door due to a locking device. In addition, an embodiment of the present invention provides a refrigerator that is capable of preventing the structures of a first door and a second door from being complicated by a locking device.

Technical Solution

In accordance with an aspect of the present invention, the above and other objects can be accomplished by the provision of a refrigerator including a main body having a storage space therein, a first door hinged to the main body for opening and closing the storage space, a door frame provided at the first door, a second door hinged to the first door, the second door having a side wall, at least a portion of which is inserted into the door frame, and a catching part provided in the side wall, and a locking device for selectively allowing the second door to be turned with respect to the first door, wherein the locking device includes a moving member, the displacement of which is changed depending on the open or closed state of the first door, and a catching member, the displacement of which is changed depending on the displacement of the moving member, whereby the protruding length of the catching member from the door frame is changed, the catching member being selectively caught in the catching part.

When the catching member protrudes from the door frame or when the protruding length of the catching member from the door frame is increased, the catching member is inserted into the catching part. In this case, the catching member is caught between the first door and the second door, thereby preventing the first door and the second door from being separated from each other. In the case in which the catching member does not protrude from the door frame or in the case in which the protruding length of the catching member from the door frame is small, the catching member is not inserted into the catching part. In this case, the catching member is not caught between the first door and the second door, whereby the first door and the second door can be separated from each other.

The linear displacement of the moving member in the state in which the first door is closed may be different from that of the moving member in the state in which the second door is open. In addition, the linear displacement of the catching member in the state in which the first door is closed may also be different from that of the catching member in the state in which the second door is open.

The first door may be provided in the rear thereof with a sub storage compartment, which is partitioned from the storage space, i.e. a main storage compartment. When the second door is opened in the state in which the first door is closed, therefore, a user may access the sub storage compartment.

The door frame may be provided inside a side wall of the first door in the radial direction, and at least a portion of the side wall of the second door may be inserted into the door frame. The door frame may have an opening, into which the second door is inserted. The door frame may surround the side wall of the second door in the state in which the second door is inserted into the door frame.

The moving member may be located between the side wall of the first door and the door frame so as to undergo linear displacement in the forward-rearward direction of the first door.

The catching member may be provided such that the protruding length of the catching member is changed toward the inside of the door frame in the radial direction. Specifically, the catching member may be provided so as to be linearly displaceable toward the inside of the door frame in the radial direction. When the protruding length of the catching member in the radial direction of the door frame is increased, the catching member may be inserted into the catching part. When the protruding length of the catching member is decreased, the catching member may be separated from the catching part. The inserted state may be the state in which the second door is locked, and the separated state may be the state in which the locked state of the second door is released.

The locking device may further include a displacement conversion part provided between the moving member and the catching member for converting the displacement of the moving member into the displacement of the catching member. That is, the displacement conversion part may be a part for converting the linear displacement of the moving member into the linear displacement of the catching member and transmitting the converted linear displacement. The transmission of the linear displacement includes the change in displacement direction.

The displacement conversion part may be a part separate from the moving member and the catching member, or may be constituted by a portion of the moving member and a portion of the catching member.

The displacement conversion part may include a first inclined surface provided at the moving member and a second inclined surface provided at the catching member so as to slide with respect to the first inclined surface in the state of contacting the first inclined surface.

The second inclined surface may slide with respect to the first inclined surface as the linear displacement of the moving member is changed, whereby the catching member may have linear displacement perpendicular to the linear displacement of the moving member.

The locking device may further include a housing provided in the first door for receiving the moving member and the catching member, the housing being provided to guide the movements of the moving member and the catching member. The housing may receive the moving member and the catching member such that the rotational displacements of the moving member and the catching member are prevented and only the linear displacements of the moving member and the catching member are allowed.

The housing may be provided in the rear thereof with a first through part, through which at least a portion of the moving member is introduced and withdrawn, and the housing may be provided in the front lower part thereof with a second through part, through which at least a portion of the catching member is introduced and withdrawn.

The first door may be provided in a rear wall thereof with a first through hole, through which at least a portion of the moving member is introduced and withdrawn, and the door frame may be provided with a second through hole, through which at least a portion of the catching member is introduced and withdrawn.

The locking device may further include an elastic member elastically deformed by the displacements of the moving member and the catching member so as to generate an elastic restoring force. The elastic member may be provided in the housing.

A rotary shaft or axis of the first door and a rotary shaft of axis of the second door may be provided so as to be parallel to each other. The rotary shafts or axes may be perpendicular to the ground, and the first door and the second door may be opened and closed in the same direction.

The locking device may be provided at a position opposite the position at which the rotary shaft of the first door is located about the leftward-rightward middle of the first door. That is, the locking device may be provided at a position substantially symmetric to the position at which the rotary shaft of the first door is located. In particular, the locking device may be provided at the upper side of the first door.

The refrigerator may further include a first door gasket provided at a rear wall of the first door for forming a closed loop to prevent the leakage of cool air and a second door gasket provided at a rear wall of the second door for forming a closed loop to prevent the leakage of cool air. The first door gasket may be provided to prevent the leakage of cool air between the main storage compartment and the first door. The second door gasket may be provided to prevent the leakage of cool air between the sub storage compartment and the second door.

The second door may be closed as the second door is inserted into the first door. Consequently, the front area of the first door is larger than that of the second door. This means that the inner region of the closed loop formed by the first door gasket is larger than that of the closed loop formed by the second door gasket.

When viewed from the front of the door, the closed loop formed by the second door gasket is located inside the closed loop formed by the first door gasket in the radial direction. A gap is formed between the first door gasket and the second door gasket.

The moving member may be located outside the closed loop formed by the first door gasket, and the catching part may be located outside the closed loop formed by the second door gasket. Consequently, it is possible to prevent the leakage of cool air from the main storage compartment due to the moving member and to prevent the leakage of cool air from the sub storage compartment due to the catching part. In other words, it is possible to prevent the deterioration of heat insulation performance due to the positional relationship between the gaskets and the locking device.

When the first door comes into tight contact with the main body and is closed, the moving member may be pushed by the main body and may be moved to the front of the first door, and the catching member may move upward as the result of the forward movement of the moving member, whereby the caught state of the catching member in the catching part may be released. On the other hand, when the first door is opened and the tight contact between the first door and the main body is released, the moving member may move to the rear of the first door, and the catching member may move downward as the result of the rearward movement of the moving member, whereby the catching member may be inserted into the catching part.

The catching member may be provided at an end thereof that is inserted into the catching part with an inclined surface, the forward-rearward width of which is decreased in the direction in which the second door is closed. The second door may be closed in the state in which the catching member protrudes. In this case, the impact between the second door and the catching member may be reduced, with the result that the catching member may be located in position. That is, the protruding length of the catching member may be decreased when the catching member collides with the second door, and the protruding length of the catching member may be increased when the second door is fully closed.

In accordance with another aspect of the present invention, there is provided a refrigerator including a main body having a storage space therein and a gasket contact part provided outside the storage space, a first door hinged to the main body for opening and closing the storage space, the first door being provided at a rear wall thereof with a gasket contact part corresponding to the gasket contact part of the main body, a door frame provided at the first door, the door frame having a gasket contact part, a second door hinged to the first door, the second door being provided at a rear wall thereof with a gasket contact part corresponding to the gasket contact part of the door frame, the second door having a catching part, which is selectively received in the door frame, and a locking device for selectively allowing the second door to be turned with respect to the first door, wherein the locking device includes a moving member configured to move to the front of the first door from outside the gasket contact part of the first door in the radial direction as the result of contacting the main body and a catching member, the protruding length of which is increased toward the inside of the door frame in the radial direction as the result of the forward movement of the moving member such that the catching member is selectively caught in the catching part.

The second door may include a side wall, at least a portion of which is inserted into the door frame such that the side wall is received inside the door frame when the gasket contact part of the door frame and the gasket contact part of the second door come into tight contact with each other. The catching part may be provided in the side wall.

The catching part may be provided outside the gasket contact part of the second door in the radial direction.

In accordance with another aspect of the present invention, there is provided a refrigerator including a main body having a storage space therein, a first door hinged to the main body for opening and closing the storage space, a door frame provided at the first door, the door frame being configured to extend through a portion of the front region of the first door, a second door hinged to the first door for opening and closing a space inside the door frame, the second door having a side wall, at least a portion of which is inserted into the door frame in the state in which the second door is closed, and a catching part provided in the side wall, and a locking device for selectively allowing the second door to be turned with respect to the first door, wherein the locking device includes a moving member configured to move to the front of the first door in the state in which the first door is closed and a catching member configured to protrude toward the inside of the door frame in the radial direction as the result of the forward movement of the moving member such that the catching member is caught in the catching part.

In accordance with a further aspect of the present invention, there is provided a refrigerator including a main body having a main storage space therein, a first door hinged to the main body for opening and closing the main storage space, the first door having a sub storage compartment, a door frame provided at the first door, a second door hinged to the first door for opening and closing the sub storage compartment, the second door having a side wall, at least a portion of which is inserted into the door frame, and a catching part provided in the side wall, and a locking device for allowing the second door to be turned with respect to the first door in the state in which the first door is closed and preventing the second door from being turned with respect to the first door in the state in which the first door is open.

The locking device may include a moving member having a forward-rearward displacement changed depending on the open or closed state of the first door and a catching member having a displacement perpendicular to that of the moving member as the result of the displacement of the moving member, the catching member being selectively caught in the catching part.

The moving member and the catching member may come into direct or indirect contact with each other such that the displacement of the moving member is converted into the displacement of the catching member.

The features of the above embodiments may be applied in combination with those of other embodiments unless the features are contradictory or exclusive.

Advantageous Effects

According to an embodiment of the present invention, it is possible to provide a refrigerator that is capable of preventing a second door from being separated from a first door due to inertia. In particular, it is possible to provide a refrigerator that is capable of preventing a second door from being separated from a first door when the first door is closed. Consequently, it is possible to provide a safe refrigerator that is capable of preventing a user from colliding with a second door.

According to an embodiment of the present invention, it is possible to provide a refrigerator that is capable of preventing the deterioration in the design of the refrigerator due to a locking device, thereby providing an aesthetically pleasing appearance. In particular, it is possible to provide a refrigerator configured such that a locking device and the operation of the locking device are out of the visual field of a user, thereby providing a safe and aesthetically pleasing appearance.

According to an embodiment of the present invention, it is possible to provide a refrigerator that is capable of enabling the closed state and the open state of a first door to be easily structurally checked, whereby the construction of a locking device is very simple and the reliability of the locking device is guaranteed. In addition, it is possible to provide a refrigerator that can be manufactured easily with reduced cost.

According to an embodiment of the present invention, it is possible to provide a refrigerator that is capable of minimizing the deterioration in the heat insulation function of a first door and a second door due to a locking device. In addition, it is possible to provide a refrigerator that is capable of preventing the structures of a first door and a second door from being complicated by a locking device.

According to an embodiment of the present invention, it is possible to provide a refrigerator configured such that a locking device can be automatically operated depending on the manner in which a door is used even though a user is not aware of the locking device or the operation of the locking device, whereby the refrigerator is very safe and convenient to use.

BEST MODE

Hereinafter, preferred embodiments of the present invention will be described in detail with reference to the accompanying drawings.

Figure 1:
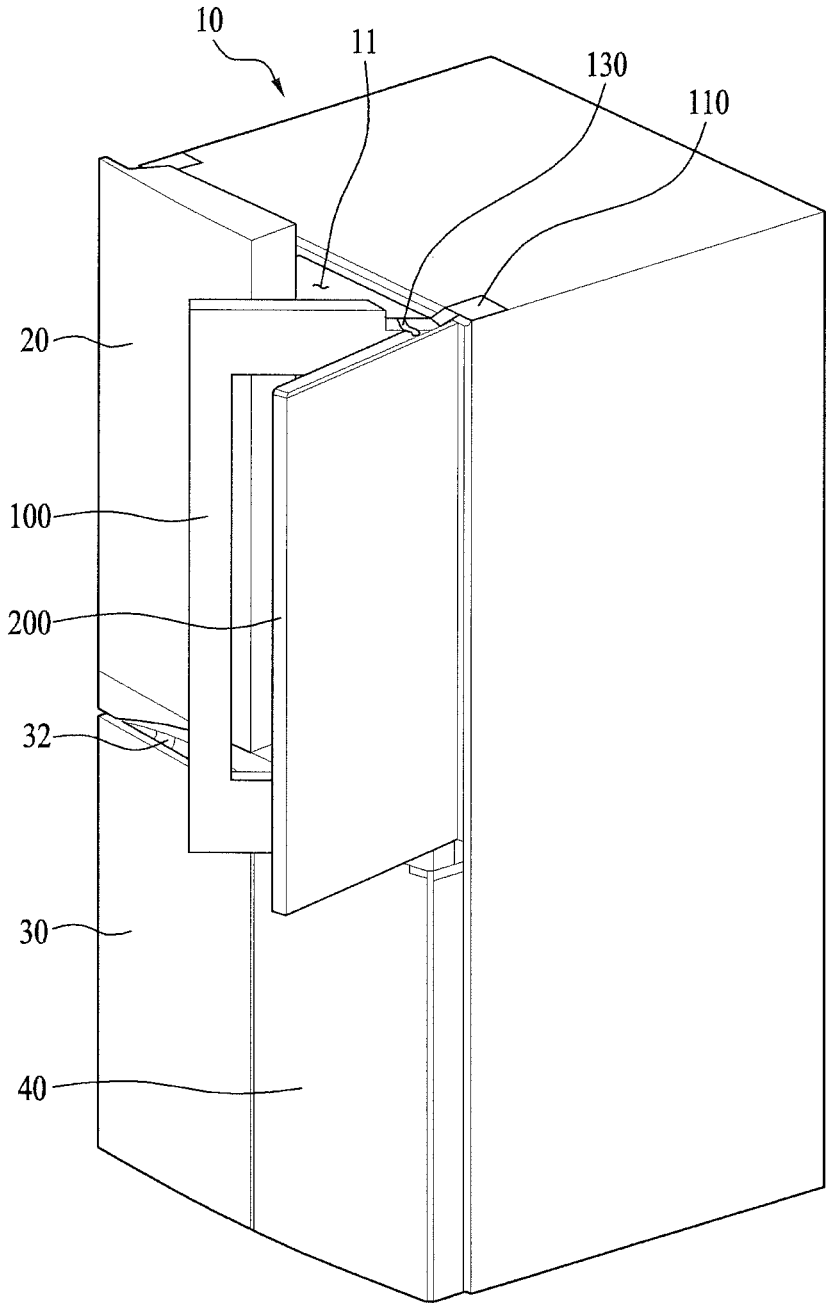
FIG. 1 is a view showing an example of a conventional dual-door refrigerator or a conventional DID refrigerator.
Figure 2:
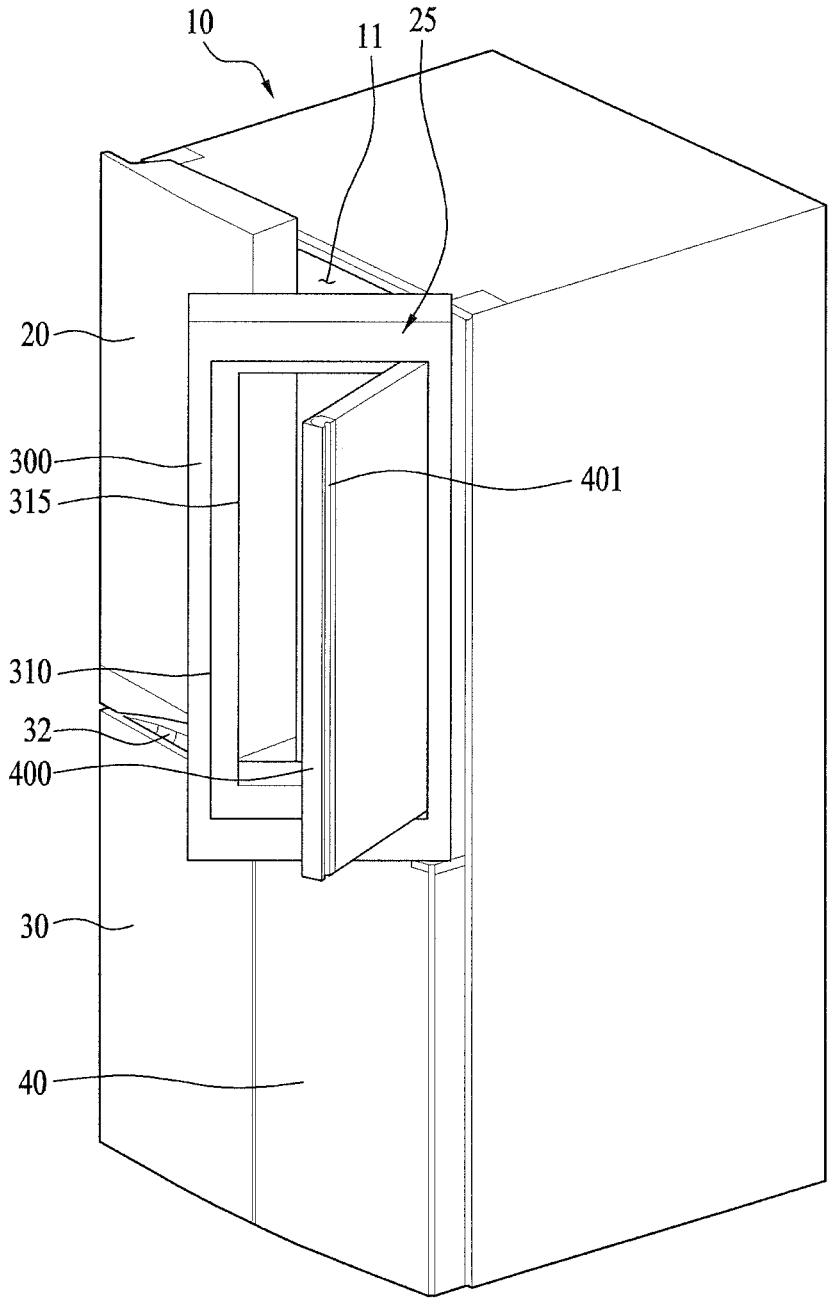
FIG. 2 is a view showing an example of a refrigerator according to an embodiment of the present invention.

FIG. 2 is a view showing an example of a refrigerator according to an embodiment of the present invention. Of course, the technical idea of the present invention may be applied to a side by side refrigerator, a refrigerator having a single door, and a refrigerator having a sub door (a second door) that is turnable with respect to a main door (a first door), in addition to the refrigerator shown.

In the embodiment shown, a right refrigerating compartment door 25 includes a main door 300 (hereinafter, referred to as a first door) hinged to a main body 10, the first door having an opening 310 formed in the inner middle part thereof, and a sub door 400 (hereinafter, referred to as a second door) hinged to first door 300 so as to be inserted into the opening 310 in the first door 300. Of course, the relationship between the first door and the second door may be applied to a left refrigerating compartment door, a single refrigerating compartment door, or a single freezing compartment door.

In the refrigerator according to this embodiment, the second door 400 is smaller than the first door 300 such that the second door 400 is inserted into the opening 310 in the first door 300 when closed. That is, at least a portion of the forward-rearward width of the second door 400 may be received in the first door. In other words, at least a portion of the side of the second door 400 may be inserted into the opening 310 in the first door.

Consequently, the refrigerator according to this embodiment is a refrigerator configured such that the second door 400 is inserted into the first door 300 in the state in which the first door 300 is closed. This type of refrigerator may be called an inside type DID refrigerator or an inside type dual-door refrigerator.

Figure 3:
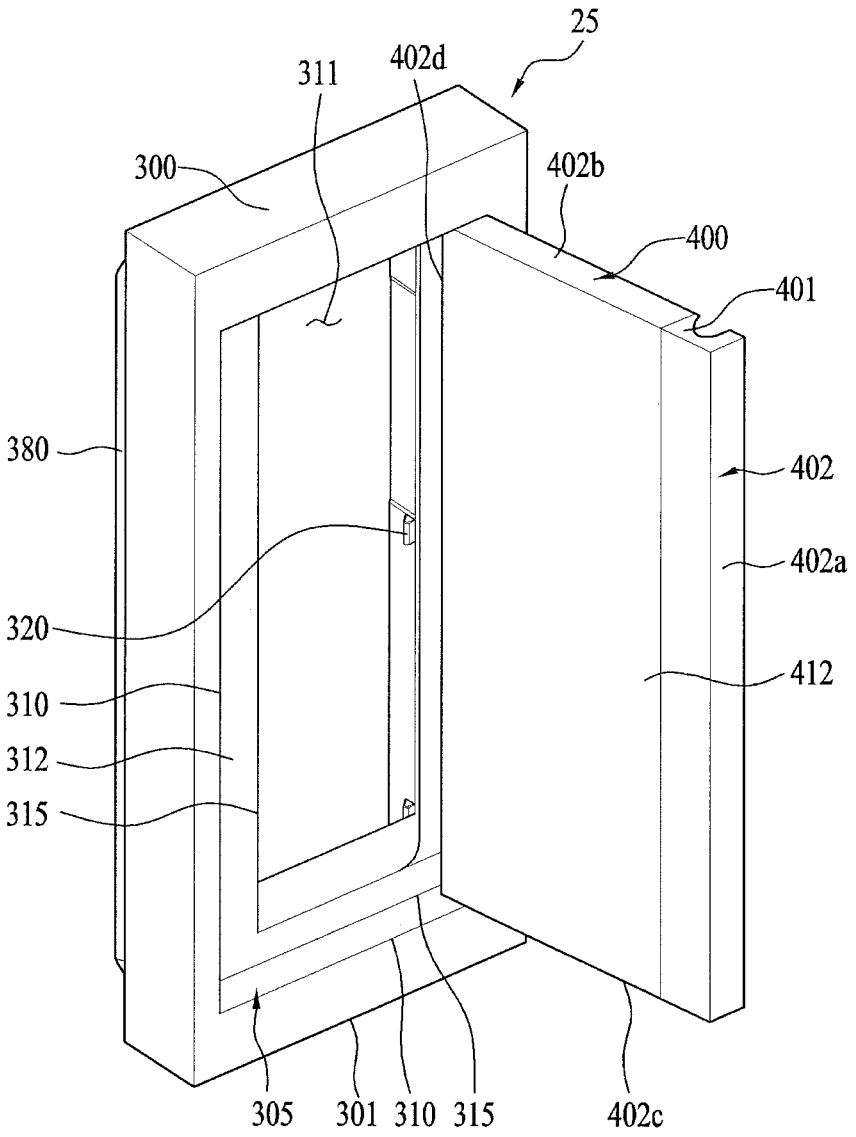
FIG. 3 is a view showing a first door and a second door shown in FIG. 2.

FIG. 3 is a view showing the doors (the first door and the second door) shown in FIG. 2.

An opening 315 may be provided in the inner middle part of the first door 300, and a sub storage compartment 311 may be provided in the rear of the first door 300. That is, the opening 310, into which the sub door 400 is inserted, and the opening 315, through which the sub storage compartment 311 is accessed, may be formed in the first door 300. The opening 315 may be located inside the opening 310 in the radial direction.

A flat part for sealing may be formed between the openings 310 and 315. The flat part may be called a gasket contact part 312. The gasket contact part 312 formed at the first door corresponds to a gasket contact part 412, which is formed at the second door 400.

The gasket contact parts 412 and 312 correspond to each other. A gasket may be provided on either one of the gasket contact parts 412 and 312. A seal between the first door 300 and the second door 400 may be achieved by the gasket contact parts 412 and 312. Consequently, the sub storage compartment 311 may be substantially located inside the gasket contact parts 412 and 312 in the radial direction.

The second door 400 may be opened to access the sub storage compartment 311 through the opening 315 of the first door 300. That is, only the second door 400 may be opened to access the sub storage compartment 311 without opening the first door 300.

The sub storage compartment may be defined by mounting a plurality of baskets in the upward-downward direction. Specifically, a cover (not shown) for covering the baskets (not shown) may be provided. The cover may function as a partition wall for partitioning the sub storage compartment 311 and the main storage compartment 11 from each other. Consequently, the sub storage compartment may be located in front of the main storage compartment.

As shown in FIG. 3, mounting protrusions 320 for mounting the baskets may be provided at the inner surface of the rear of the opening 315 of the second door 300. Two or three pairs of baskets may be mounted so as to be spaced apart from each other by a predetermined distance in the upward-downward direction. As shown in FIG. 3, therefore, the second door 400 may be opened in the state in which the first door 300 is closed such that a user can access the sub storage compartment 311.

Specifically, the first door 300 includes a door frame 305. Of course, the first door 300 may include a door frame 305, in which the second door is selectively received. In addition, the first door 300 itself may be the door frame 305. The opening 310 may be formed in the door frame 305. When the second door 400 is received in the door frame 305, it may mean that the second door 400 is closed. When the second door 400 is substantially separated from the door frame 305, it may mean that the second door 400 is open. FIG. 3 shows the state in which the second door 400 is open.

The second door 400 may be provided with a handle 401. The user may open and close the second door 400 while holding the handle 401. In addition, the first door 300 may also be provided with a handle 301. Specifically, the handle 301 of the first door 300 may be provided at the edge of the door frame 305. That is, the handle 301 of the first door 300 may be provided at the side edge or the lower edge of the door frame 305. The handles 301 and 401 may have various forms or shapes. The handles may be provided separately.

More specifically, the handle 301 of the first door 300 and the handle 401 of the second door 400 may be provided separately such that the handle 301 can open and close the first door and the handle 401 can open and close the second door.

As will be described later, in order to normally open the first door 300, the user opens the first door 300 while holding the handle 301 of the first door. At this time, the user opens the first door 300 against the magnetic force generated between the first door 300 and the main body 10. The magnetic force is generally generated by a rubber magnet gasket. In the same manner, in order to normally open the second door 400, the user opens the second door 400 while holding the handle 401 of the second door. At this time, the user opens the second door 400 against the magnetic force generated by a rubber magnet gasket.

In the normal state (in the state in which the first door is closed), therefore, the second door may be opened against the magnetic force of the rubber magnet gasket generated between the first door 300 and the second door 400. That is, an additional device or additional force for preventing separation therebetween may be excluded. For this reason, the second door 400 may be abnormally separated from the first door 300. That is, when the first door 300 is slammed in the state in which both the first door 300 and the second door 400 are open, the first door 300 is separated from the second door 400, with the result that only the first door 300 is closed, since the inertial force of the second door 400 is greater than the magnetic force therebetween.

In this embodiment, as will be described later, it is possible to effectively prevent the above problem.

Hereinafter, a refrigerator to which a locking device according to an embodiment of the present invention is applied will be described in detail with reference to FIGS. 4 to 7.

The refrigerator according to this embodiment includes a locking device 500 for selectively allowing the second door 400 to turn with respect to the first door 300. In other words, the locking device selectively prevents the second door 400 from turning with respect to the first door 300.

More specifically, the locking device 500 is provided to allow the second door 400 to turn with respect to the first door 300 in the case in which the first door 300 is closed and to prevent the second door 400 from turning with respect to the first door 300 in the case in which the first door 300 is open. That is, in the state in which the first door 300 is open, the second door 400 is locked to the first door 300, thereby preventing the opening of the second door 400. The locking device 500 performs the above-described functions.

In the case in which the first door 300 is closed, the user may open the second door 400 while holding the handle 401 of the second door 400. At this time, because the locking of the locking device 500 is released, the user may easily open the second door 400 against the magnetic force of the gasket generated between the first door 300 and the second door 400. Of course, the frictional force generated by a hinge may be ignored.

In the case in which the first door 300 is open, on the other hand, the user may attempt to open the second door 400 while holding the handle 401 of the second door 400. At this time, the locking of the locking device 500 is maintained. As a result, the user cannot open the second door 400. That is, the second door 400 cannot be separated from the first door 300. For this reason, it is possible to prevent the second door 400 from being separated from the first door 300 (i.e. to prevent the second door 400 from being opened) when the first door 300 is slammed in the state in which the first door 300 is open.

Figure 4:
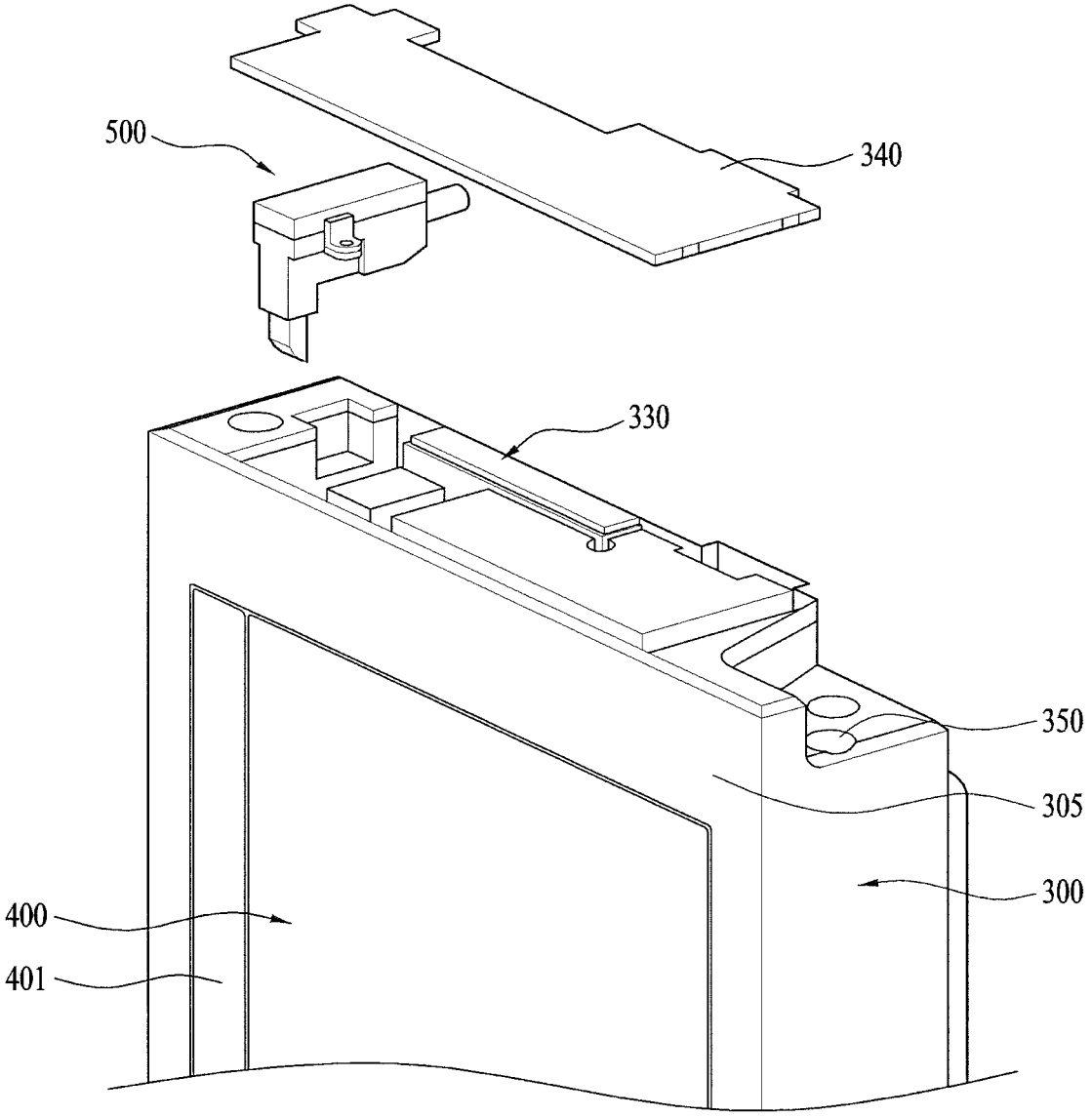
FIG. 4 is a view showing the state in which a locking device is separated from the first door and the second door of the refrigerator according to the embodiment of the present invention.

The turning directions of the first door 300 and the second door 400 when opened and closed may be the same. For example, as shown in FIG. 4, the first door 300 and the second door 400 may be turned about vertical rotary shafts provided at the right sides thereof. Specifically, the first door 300 may be turned with respect to the main body 10 about a rotary shaft 350, and the second door 400 may be turned with respect to the first door 300 about a rotary shaft (not shown). When the first door 300 is closed, the second door 400 may be separated from the first door 300 due to the inertia of the second door 400 depending on the relationship between the turning directions of the first door 300 and the second door 400.

The locking device 500 may be provided in order to prevent the second door 400 from being separated from the first door 300. In addition, in order to effectively prevent the separation therebetween, the locking device 500 may be located so as to be as distant from the rotary shaft 350 of the first door 300 as possible. That is, the locking device 500 may be located at a position at which the moment distance is sufficiently secured.

For example, in the case in which the rotary shaft 350 of the first door 300 is located adjacent to the left end of the first door, the locking device 500 may be located adjacent to the right end of the first door.

In addition, the first door 300 may include a door frame 305 for receiving the second door 400. The first door 300 or the door frame 305 may include a door decoration trim 330 that defines the top surface of the first door 300 or the door frame 305.

The first door 300 may include a decoration trim cover 340 for covering the door decoration trim 330. Between the door decoration trim 300 and the decoration trim cover 340 may be defined a predetermined space, in which the locking device 500 may be provided.

In the case in which the rotary shaft 350 of the first door 300 is provided at the right side of the first door 300, the locking device 500 may be located at the left upper part of the first door. That is, sufficient moment distance is secured, whereby it is possible to provide a safe locking device.

Hereinafter, the locking device 500 will be described in detail with reference to FIG. 5.

The locking device 500 includes a moving member 506, the displacement of which is changed depending on the open or closed state of the first door 300. That is, the locking device 500 may be a member that recognizes the open or closed state of the first door 300 or responds thereto. In other words, the moving member 506 may be a member that immediately responds to the open or closed state of the first door 300. More specifically, the displacement of the moving member 506 in the state in which the first door 300 is closed is different from that of the moving member 506 in the state in which the second door 300 is open. The locking device 500 includes a catching member 507, the displacement of which is changed depending on the displacement of the moving member 506.

In the state in which the first door 300 is closed, the moving member 506 comes into contact with the main body 10, with the result that the moving member 506 is pushed by the main body 10. That is, when the first door 300 is closed, the moving member 506 moves to the front of the refrigerator. In other words, the moving member 506 has a forward linear displacement.

In the state in which the first door 300 is open, the pushed state of the moving member 506 is released. That is, the contact between the main body 10 and the moving member 506 is released, with the result that the moving member 506 may be returned to the original position thereof. That is, the moving member 506 has a rearward linear displacement. In order to return the moving member to the original position thereof, an elastic member 508 may be provided. That is, when force pushing the moving member 506 is removed, the protruding length of the moving member 506 is increased (the original position, i.e. the state in which the first door is open). When force pushing the moving member 506 is generated, the protruding length of the moving member 506 is decreased (the elastically deformed position, i.e. the state in which the first door is closed).

Consequently, it is possible to determine whether the first door 300 is closed or open depending on the change in linear displacement of the moving member 506.

The linear displacement of the catching member 507 is changed in response to that of the moving member 506. That is, the second door 400 may be selectively locked to the first door 300 as the linear displacement of the catching member 507 is changed. This locking mechanism will be described later.

Figure 5:
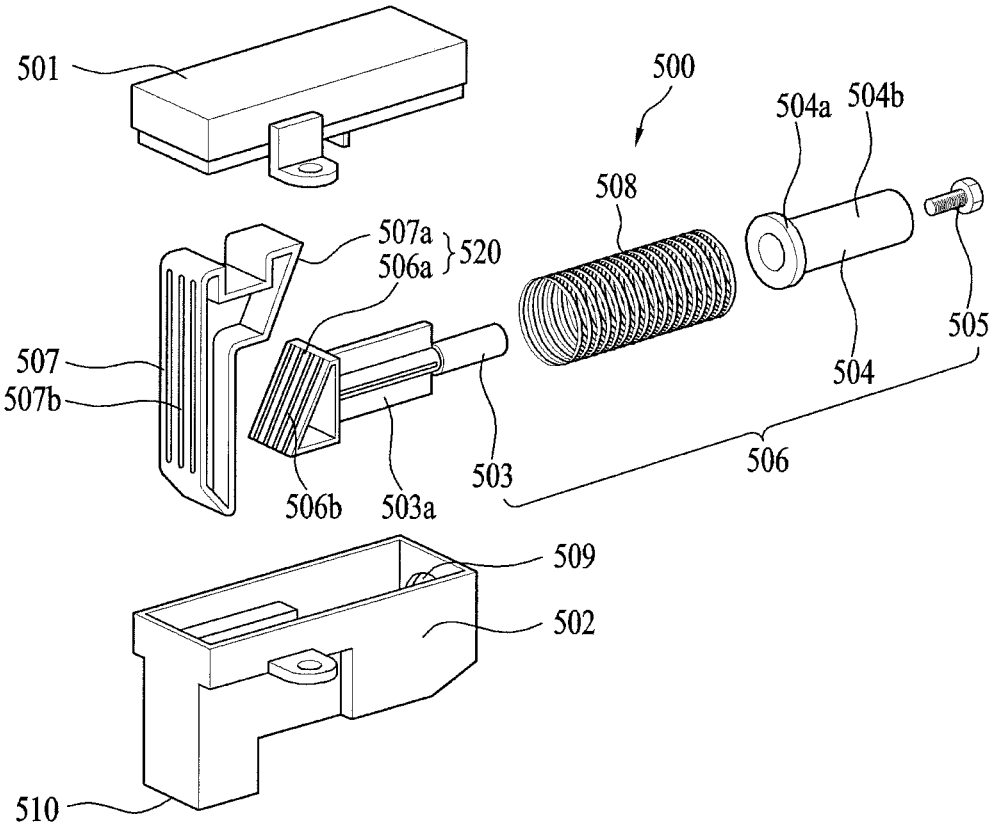
FIG. 5 is an exploded view showing the locking device shown in FIG. 4.

As shown in FIG. 5, the locking device 500 may include a housing for receiving the moving member 506 and the catching member 507. The major portions of the moving member and the catching member may be received in the housing. The housing may include an upper housing 501 and a lower housing 502, which are coupled to each other to define a space therebetween. The moving member and the catching member may be received in the space.

The space in the housing may be a space in which the major portions of the moving member 506 and the catching member 507 are received and in which displacement conversion between these members is performed. The space in the housing may be a space in which the elastic member 508 is received. As previously described, the elastic member 508 is provided to return the moving member 506 to the original position thereof upon receiving external force applied to the moving member. That is, displacement occurrence, displacement conversion, elastic deformation, and elastic restoration may be performed in the space isolated from the outside. Here, the displacement of these members may be linear displacement. That is, the displacement of the moving member, the catching member, and the elastic member may be linear displacement. Since these members are received in the housing, therefore, it is possible to prevent displacement occurrence and displacement conversion from being disturbed by external interference. In addition, it is possible to greatly reduce the installation space of the locking device 500, including the housing, since the housing is provided to allow the members to have linear displacement while receiving the members.

The housing may be provided in one side thereof with a first through part 509, through which the moving member 506 extends. The housing may be provided in the other side thereof with a second through part 510, through which the catching member extends.

At least a portion of the moving member 506 is introduced and withdrawn through the first through part 509 in the state in which the moving member 506 extends through the first through part 509. At least a portion of the catching member 507 is introduced and withdrawn through the second through part 510 in the state in which the catching member 507 extends through the second through part 510.

In the state in which the first door 300 is closed, the moving member 506 moves to the inside of the housing through the first through part 509. At this time, the catching member 507 moves to the inside of the housing through the second through part 510. That is, in the state in which the first door 300 is closed, the protruding lengths of the moving member 506 and the catching member 507 are decreased. That is, the protruding lengths of the moving member and the catching member with respect to the housing 501 and 502 are decreased.

In the state in which the first door 300 is open, on the other hand, the length of the moving member 506 protruding through the first through part 509 is increased. In addition, the length of the catching member 507 protruding through the second through part 510 is also increased. That is, the increase in protruding length of the catching member 507 means that the turning of the second door 400 with respect to the first door 300 is prevented, and the decrease in protruding length of the catching member 507 means that the turning of the second door 400 with respect to the first door 300 is allowed.

The moving member 506 may be a single member, or may include a plurality of members. For example, the moving member 506 may include a push bar 504 and a conversion member 503 connected to the push bar 504. The moving member 506 may include a coupling member 505 for coupling the push bar 504 and the conversion member 503 to each other. The moving member 506 may move back and forth.

The push bar 504 may be a part that directly contacts the main body 10 of the refrigerator. The conversion member 503 may be a part for transmitting the displacement of the moving member 506 to the catching member 507.

Specifically, the push bar 504 may include a flange **504*a* and an extension 504*b*. The outer diameter of the flange 504*a* is larger than the inner diameter of the first through part 509. The flange 504*a* is located in the housing 501 and 502. Consequently, the maximum protruding length of the push bar 504 is limited as the result of the flange 504 being caught in the first through part 509**.

In addition, the extension **504*b* may be a part that extends through the first through part 509 so as to selectively contact the main body 10. The extension 504*b* may have a hollow part, through which a screw 505 is inserted. The push bar 504 may be coupled to the conversion member 503 by the screw 505**.

The conversion member 503 may be inserted into the elastic member 508. One side of the elastic member 508 may be fixed at a specific position in the housing, and the other side of the elastic member 508 may be fixed to the flange **504*a*. When the moving member 506 moves in the housing in the direction in which the protruding length of the moving member is decreased, the flange 504*a* may push the elastic member 508, with the result that the elastic member may be elastically deformed. When the external force applied to the moving member is removed, the moving member 506** is moved by the elastic restoring force of the elastic member in the direction in which the protruding length of the moving member is decreased.

Specifically, in the state in which the first door 300 is closed, the push bar 504 is pushed. In the state in which the first door 300 is open, the push bar 504 is returned to the original position thereof. To this end, the elastic member 508 may be provided. That is, the elastic member 508 may be provided at the moving member 506 in order to return the moving member 506 to the original position thereof (the position thereof in the state in which the first door is open). Alternatively, the elastic member 508 may be provided to return the catching member 507 to the original position thereof. The reason for this is that returning the catching member 507 to the original position thereof means returning the moving member 506 to the original position thereof, since the moving member and the catching member remain in contact with each other.

For this reason, the shape of the catching member 507 may be similar to that of the moving member 506. In addition, the catching member 507 may be inserted into the elastic member. When the first door is closed, and therefore the protruding length of the catching member 507 is decreased, the elastic member is elastically deformed. In the opposite case, the elastic member returns to the original position thereof. Consequently, the catching member 507 is returned to the original position thereof (the state in which the protruding length of the catching member is increased).

Of course, elastic members may be provided at both the moving member 506 and the catching member 507, since the moving member and the catching member are interlocked.

In the state in which the catching member 507 is inserted into a catching part 420, however, the user may pull the second door. In this case, the catching member 507 must maintain the locked state of the second door against the force applied by the user. That is, relatively large shear force may be applied to the catching member 507. On the other hand, no shear force is applied to the moving member 506, although external force is substantially applied to the moving member in the longitudinal direction. Consequently, the catching member 507 may have higher rigidity than the moving member 506.

For this reason, the sectional area or geometrical moment of inertia of the catching member 507 may be larger than that of the moving member 506. In the case in which the sectional area or geometrical moment of inertia of the catching member 507 is increased, the total volume of the locking device may be increased when the elastic member receives the catching member.

Consequently, the elastic member may be provided at any one of the catching member 507 and the moving member 506, particularly only the moving member 506, although the elastic member may be provided at each of the catching member 507 and the moving member 506. In addition, since the displacement of the moving member 506 is changed depending on the open or closed state of the first door, the elastic member may be provided at the moving member so as to respond quickly.

Meanwhile, the moving member 506 is provided so as to extend further from the flange 504*a*. In addition, the moving member may be provided such that linear displacement of the moving member is easily performed. Consequently, it is necessary for the moving member 506 to be relatively light. In addition, it is necessary for the frictional force between the moving member and the housing 501 and 502 to be small. To this end, the moving member 506 may include a plurality of blades 503*a*. The blades may be formed radially. The frictional area between the moving member and the housing may be effectively reduced while the weight of the moving member 506 may be reduced by the provision of the blades. The reason for this is that the moving member 506 can come into line contact with the housing 501 and 502.

In the housing 501 and 502 may be provided a partition wall 502*a*, through which the moving member 506 moves. Specifically, the conversion member 503 may extend through the partition wall 502*a*. An inclined surface 506*a* provided at one side of the conversion member 503 is located on one side of the partition wall 502*a*, and the blades 503*a* are located on the other side of the partition wall 502*a*.

The elastic member 508 may be located at the partition wall 502*a* and the flange 504*a* of the push bar. When the flange 504*a* moves toward the partition wall 502*a*, the elastic member 508 may be compressed. In the opposite case, the elastic member 508 may be relaxed.

The catching member 507 may be a single member. The catching member 507 may be provided so as to have linear displacement vertically in response to the linear displacement of the moving member 506.

The displacement transmission and displacement conversion between the moving member 506 and the catching member 507 may be performed through a displacement conversion part 520. The displacement conversion part may be a separate member between the moving member 506 and the catching member 507, or may be constituted by a portion of the moving member 506 and a portion of the catching member 507.

Specifically, the displacement conversion part 520 may be constituted by inclined surfaces between the moving member 506 and the catching member 507. Specifically, an inclined surface 506*a* of the moving member 506 and an inclined surface 507*a* of the catching member 507 are provided so as to contact each other. The moving member and the catching member may slide along the inclined surfaces. Consequently, the displacement conversion part 520 may by constituted by the inclined surface 506*a* of the moving member 506 and the inclined surface 507*a* of the catching member 507, which are provided so as to contact each other.

When the moving member 506 is moved in the direction in which the catching member 507 is pushed, the inclined surface 507*a* of the catching member 507 is moved upward along the inclined surface 506*a* of the moving member 506. When the moving member 506 is moved in the opposite direction, the inclined surface 507*a* of the catching member 507 is moved downward along the inclined surface 506*a* of the moving member 506. Consequently, the linear displacement of the moving member is converted into the linear displacement of the catching member, which is perpendicular to the linear displacement of the moving member.

The linear displacement of the moving member 506 and the catching member 507 may be properly guided through the inner structure of the housing 501 and 502. In addition, the linear displacement of the moving member and the catching member may be guided through the first through part 509 and the second through part 510. Consequently, the forward-rearward movement of the moving member 506 and the upward-downward movement of the catching member 507 may be organically and reliably performed.

In addition, a protruding part 506*b* may be formed on any one of the inclined surfaces 506*a* and 507*a*. That is, the inclined surfaces may substantially come into line contact with each other, rather than surface contact with each other. Consequently, the frictional area between the inclined surfaces may be reduced, thereby performing more effective displacement conversion.

The protruding part 506*b* may be formed so as to be parallel to the sliding direction. A plurality of protruding parts 506*b* may be provided.

Meanwhile, the catching member 507 moves linearly in the housing 501 and 502. The linear movement of the catching member is guided in the housing. That is, at least the outer surface of the catching member 507 contacts the inner surface of the housing. When the catching member moves, therefore, frictional force may be increased. This means that the linear movement of the catching member may be disturbed.

The protruding part 507*b* may be formed on the outer surface of the catching member 507 in order to reduce the frictional area between the catching member and the housing. The protruding part may be formed so as to be parallel to the moving direction of the catching member. A plurality of protruding parts 507*b* may be provided. The catching member 507 comes into line contact with the housing due to the provision of the protruding parts.

Here, the upward-downward movement of the catching member 507 is based on the premise that the locking device 500 is mounted at the left upper end of the first door. That is, the locking device is mounted to the door decoration trim, which defines the top surface of the first door 300 such that the catching member 507 moves in the upward-downward direction. Of course, in the case in which the locking device 500 is mounted at the left side of the first door, the catching member 507 moves in the leftward-rightward direction. Consequently, the moving direction of the catching member 507 may be changed depending on the position or orientation at which the locking device 500 is mounted. In any case, the catching member 507 moves linearly in the direction perpendicular to the direction in which the moving member 506 moves linearly in the forward-rearward direction.

Figure 6:
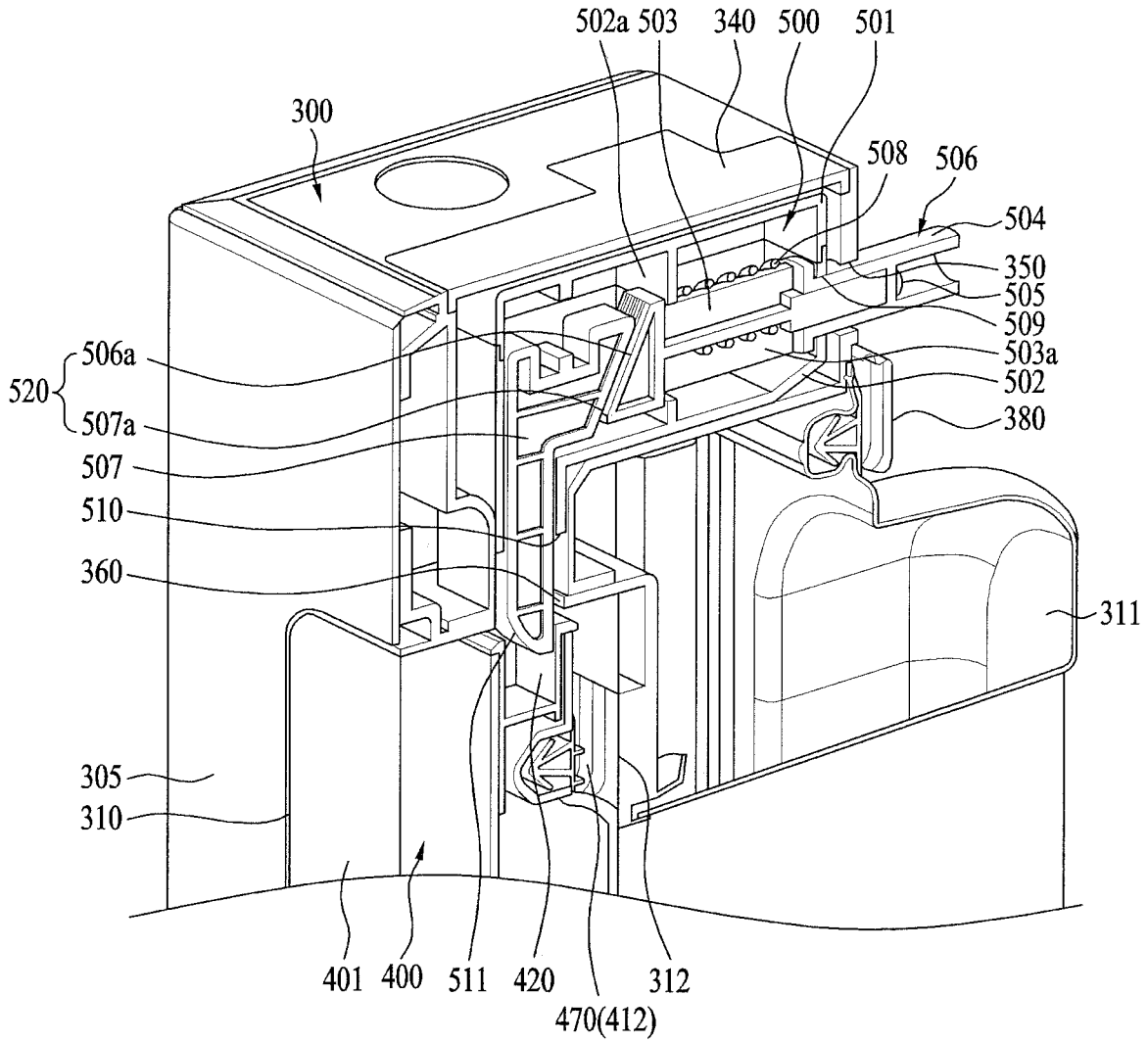
FIG. 6 is a sectional view of the first door and the second door shown in FIG. 4 taken along the middle of the locking device, showing the second door locked by the locking device in the state in which the first door is open.
Figure 7:
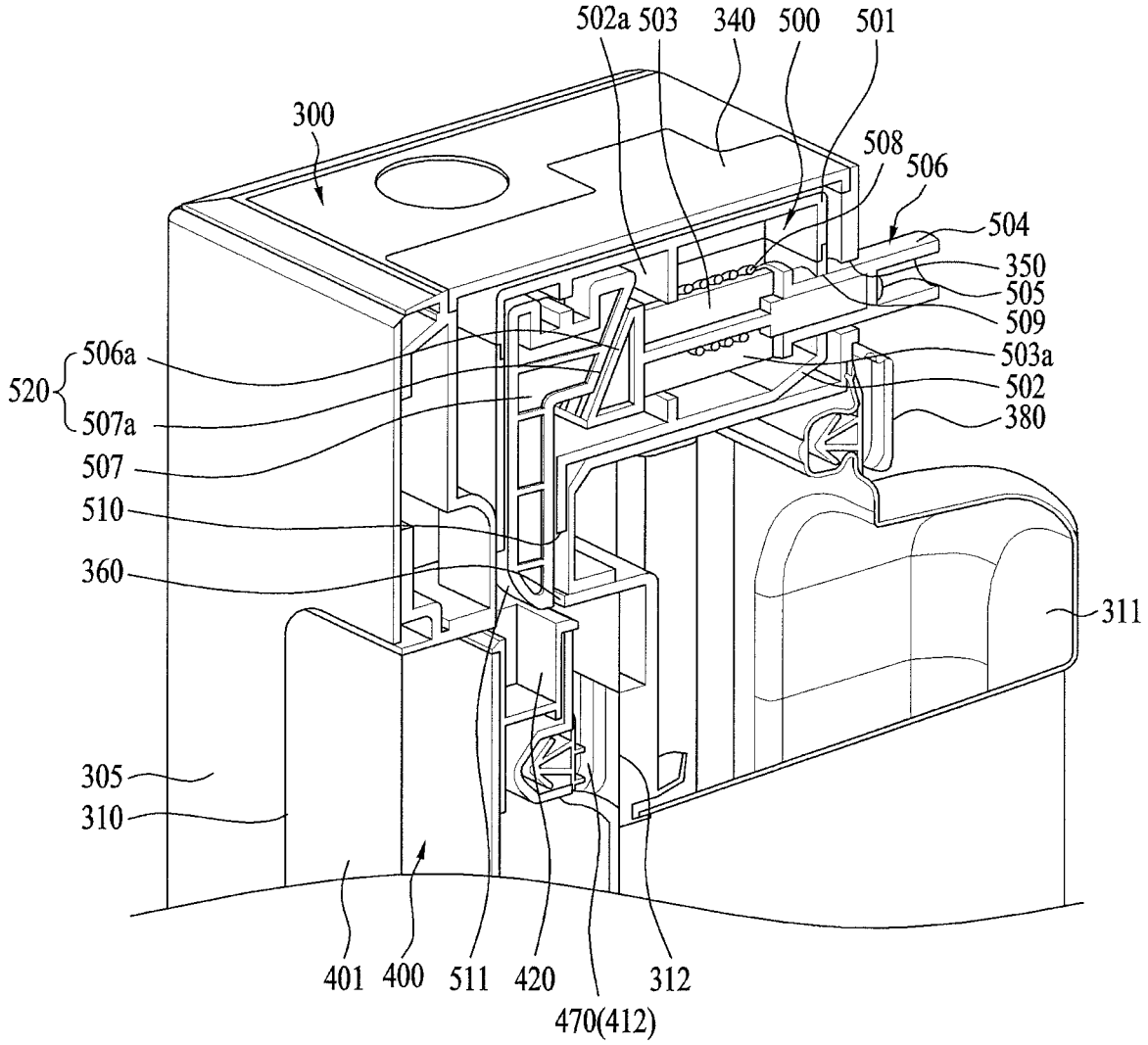
FIG. 7 is a view showing the state of the second door locked by the locking device being released in the state in which the first door is closed.

Hereinafter, the mechanism of the locking device 500 will be described in detail with reference to FIGS. 6 and 7. FIGS. 6 and 7 are sectional views of the first door 300 and the second door 400 taken along the middle of the locking device in the leftward-rightward direction. FIG. 6 shows the state in which the first door 300 is open, and FIG. 7 shows the state in which the first door 300 is closed. Of course, in FIGS. 6 and 7, the second door 400 is coupled to the first door 300. For the sake of convenience, the front part of the second door 400 is omitted. That is, the front part of the second door 400 corresponding to the handle 4010 of the second door shown in FIG. 3 is omitted.

The second door 400 is inserted into the opening 310 formed in the door frame 305 of the first door 300, with the result that the second door 400 is closed. Of course, the entirety of the forward-rearward width of the second door 300 may be inserted into the opening 310, or a portion of the forward-rearward width of the second door 300 may be inserted into the opening 310. That is, at least a portion of a side wall 402 of the second door 400 may be inserted into the opening 310.

The second door 400 may be substantially quadrangular. As shown in FIG. 3, therefore, the second door 500 may include an upper side wall 402*b*, a lower side wall 402*c*, a left side wall 402*a*, and a right side wall 402*d*. The catching part 420 may be formed in one of the side walls.

Specifically, in the case in which the rotary shaft of the second door 400 is provided at the right side thereof, the catching part 420 may be formed at any one of the upper side wall 402*b*, the lower side wall 402*c*, and the right side wall 402*d* of the second door 400. Of course, the locking device may be provided at a position corresponding to the catching part 420.

FIGS. 6 and 7 show an example in which the catching part 420 is located at the left upper part of the second door 400, more specifically at the right side of the upper side wall 402*b* (at a position substantially symmetric to the position at which the rotary shaft of the second door is located about the leftward-rightward middle of the second door).

The positions of the catching part 420 and the locking device 500 corresponding thereto have the following effects.

First, in consideration of the size of the refrigerator and the size of the door, the positions of the catching part 420 and the locking device 500 are higher than the visual field of the user. In other words, the catching part 420 and the catching member 507 are located at a place outside of the visual field of the user. Consequently, it is possible to prevent the deterioration of design due thereto.

In addition, the catching part 420 is provided in the side wall 402, which is inserted into the first door 300. When the user manipulates the first door and the second door, therefore, the catching part 420 and the catching member 507 are not exposed outward. That is, the locking operation is performed at a place outside of the visual field of the user.

Specifically, the catching part 420 may be formed in a recess shape. The catching member 507 may be selectively inserted into the catching part 420.

The catching member 507 may be provided so as to extend through the first door 300. Consequently, the catching member 507 may be inserted into the catching part 420, which is formed in the second door 400, through the first door 300. In this case, when the second door 400 is opened, the opening of the second door 400 is limited by the catching member 507.

The first door 300 may be provided with a second through hole 360, through which the catching member 507 extends. Specifically, the second through hole 360 may be formed in an inner wall of the opening 310 of the door frame 305, into which the second door 400 is inserted. In addition, the first door 300 may be provided with a first through hole 350, through which the moving member 506 extends. Specifically, the first through hole 350 may be formed in a rear wall of the door frame 305. The rear wall may be a part that contacts the main body 10 when the first door 300 is closed.

The positions of the first through hole 350 and the second through hole 360 are important. In particular, the position of the locking device 500, including the first through hole and the second through hole, is important.

As shown in FIG. 6, the first door 300 is provided with a gasket 380, and the second door 400 is provided with a gasket 470. Of course, the gaskets 380 and 470 may be respectively provided at the main body 10 and the first door 300, which are opposite each other. One gasket may be provided at any one of the first door and the main body, and the other gasket may be provided at any one of the second door and the first door.

Consequently, a surface having the gasket or a surface with which the gasket selectively comes into tight contact may be called a gasket contact part. Since the second door selectively comes into tight contact with the first door and is closed, gasket contact parts are provided at both the first door and the second door. In addition, since the first door selectively comes into tight contact with the main body and is closed, gasket contact parts are provided at both the first door and the main body.

As previously described, the second door 400 is inserted into the first door 300 with the result that the second door is closed. Consequently, the front area of the second door 400 is smaller than that of the first door 300. Due to the relationship between the first door 300 and the second door 400, the inner region of a closed loop formed by the gasket 380 of the first door is larger than that of a closed loop formed by the gasket 470 of the second door. That is, when viewed from the front of the door, the gasket 470 of the second door is located inside the gasket 380 of the first door in the radial direction.

The positional relationship between the gaskets and the locking device 500 is very important in improving heat insulation performance.

Specifically, the first through hole 350 may be located outside the gasket 380 of the first door in the radial direction. In addition, the housing 501 and 502 of the locking device 500 may also be located outside the gasket 380 in the radial direction. Consequently, it is possible to effectively prevent cool air from the region inside the gasket from being discharged to the outside through the locking device 500.

In the same manner, the second through hole 360 may be located outside the gasket 470 of the second door in the radial direction. In addition, the catching part 420 may also be located outside the gasket 470 of the second door in the radial direction. In other words, the locking device 500 and the catching part 420 may be provided outside the plane that connects the gasket of the first door and the gasket of the second door. Consequently, it is possible to effectively prevent cool air from the region inside the gasket from being discharged to the outside through the locking device 500 and the catching part 420.

As shown in FIG. 6, the protruding length of the catching member 507 is increased in the state in which the protruding length of the moving member 506 is increased. As previously described, the state in which the protruding length of the moving member 506 is increased means that the contact between the moving member 506 and the main body 10 is released, i.e. the first door 300 is open. In the state in which the first door 300 is open, therefore, the protruding length of the catching member 507 is increased, with the result that the catching member 507 is inserted into the catching part 420. That is, the catching member 507 is inserted into the second door 400 through the first door 300. Consequently, the second door 400 cannot be turned with respect to the first door 300 by the catching member 507. For this reason, the turning of the second door 400 is limited by the locking device 500.

As shown in FIG. 7, the protruding length of the catching member 507 is decreased in the state in which the protruding length of the moving member 506 is decreased. That is, the protruding length of the catching member 507 is decreased in the state in which the first door 300 is closed, with the result that the catching member 507 is separated from the catching part 420. Consequently, the state in which the second door is locked to the first door 300 is released. In the state in which the first door 300 is closed, therefore, the second door 400 may be opened and closed very easily.

Meanwhile, the catching member 507 may be provided at the end thereof with an inclined surface 511 for absorbing impact that may be generated between the second door 400 and the catching member 507. The inclined surface 511 is a part configured to be inserted into the catching part 420. The forward-rearward width of the inclined surface may decrease in the direction in which the second door 400 is closed. The inclined surface 511 may have the following effects.

As previously described, the locking device 500 is provided to prevent the second door 400 from being separated from the first door 300 in the state in which the first door 300 is open. In the state in which the first door 300 is closed, therefore, the user may easily open the second door 400. However, the locking device 500 does not restrict the opening of the first door 300 in the state in which the second door 400 is open. That is, the user may open the first door 300 in the state in which the second door 400 is open. FIG. 2 shows this state.

In this case, there is no problem when the user closes the second door 400 after closing the first door 300. However, the user may open the second door 400 in the state in which the first door 300 is not closed. At this time, the catching member 507 remains protruding, since the first door 300 is open. When the second door 400 is closed in this state, therefore, the second door 400 may collide with the catching member 507.

In order to solve this problem, the inclined surface 511 may be provided at the end of the catching member 507. When the second door 400 collides with the inclined surface 511, the protruding length of the catching member 507 is decreased. The impact applied to the catching member 507 may be absorbed by the elastic member 508. When the second door 400 is fully closed, the protruding length of the catching member 507 is increased by the restoring force of the elastic member 508. That is, the second door 400 is in the locked state. Of course, when the first door 300 is closed in this state, the locked state of the second door 400 is released.

Consequently, the inclined surface 511, which contacts the second door to generate the linear displacement of the catching member 507, may be provided at the catching member 507.

Consequently, the locking device 500 may be flexibly applied even to the case in which the user abnormally opens both the first door 300 and the second door 400.

According to the above embodiments, it is possible to provide a refrigerator to which a locking device that is very safe and convenient to use is applied.

INDUSTRIAL APPLICABILITY

Industrial applicability has been described in the best mode.

The invention claimed is:

1. A refrigerator comprising:

a main body having a main storage space therein;

a first door hinged to the main body and configured to open and close the main storage space, the first door including:

a decoration trim disposed at an upper portion of the first door, an opening defined at a middle portion of the first door, and a sub storage space defined at a rear portion of the first door;

a second door hinged to the first door and configured to open the opening to thereby provide access to the sub storage space through the opening, the second door comprising disposed at an upper surface of the second door; and a locking device disposed in the decoration trim of the first door and configured to restrict movement of the second door with respect to the first door, the locking device comprising:

a housing inserted in a recess defined at the decoration trim, a moving member configured to horizontally slide in the housing in a forward-rearward direction based on a movement of the first door, an elastic member configured to push the moving member within the housing, and a catching member configured to contact the moving member and to vertically slide along a surface of the housing based on a movement of the moving member such that a lower portion of the catching member is selectively inserted in the catching part of the second door, wherein contacting surfaces of the moving member and the catching member include inclined surfaces, and wherein the catching member includes a protruding part that is disposed at a front surface of the catching member, that faces the surface of the housing, and that is configured to reduce a friction area between the catching member and the surface of the housing.

2. The refrigerator according to claim 1, wherein at least a portion of a side wall of the second door is configured to be inserted into the opening of the first door.

3. The refrigerator according to claim 1, wherein the catching member is configured to linearly move toward an inside of the decoration trim in a vertical direction.

4. The refrigerator according to claim 1, wherein the contacting surfaces include:

a first inclined surface defined at the moving member; and a second inclined surface defined at the catching member and configured to slide with respect to the first inclined surface in a state of contacting the first inclined surface, and wherein the first inclined surface is configured to contact the second inclined surface based on the first door closing the main storage space.

5. The refrigerator according to claim 4, wherein at least one of the first inclined surface or the second inclined surface comprises another protruding part for reducing a frictional area of the contacting surfaces, and wherein the protruding part of the at least one of the first inclined surface or the second inclined surface extends in parallel to a moving direction of the at least one of the first inclined surface or the second inclined surface.

6. The refrigerator according to claim 4, wherein the second inclined surface includes an upper end and a lower end, and wherein a distance between the upper end of the second inclined surface and a front surface of the first door is greater than a distance between the lower end of the second inclined surface and the front surface of the first door.

7. The refrigerator according to claim 5, wherein the second inclined surface is configured to slide with respect to the first inclined surface based on a linear displacement of the moving member being changed, and wherein the catching member is configured to move in a direction perpendicular to the linear displacement of the moving member of the moving member.

8. The refrigerator according to claim 1, wherein the housing defines:

a first through part at a rear part of the housing, at least a portion of the moving member being configured to move through the first through part; and a second through part at a front lower part of the housing, at least a portion of the catching member being configured to move through the second through part.

9. The refrigerator according to claim 8, wherein the first door comprises:

a rear wall that defines a first through hole, at least a portion of the moving member being configured to move through the first through hole; and a door frame that defines a second through hole, at least a portion of the catching member being configured to move through the second through hole.

10. The refrigerator according to claim 1, wherein the protruding part extends in parallel to a moving direction of the catching member.

11. The refrigerator according to claim 1, wherein a rotary axis of the first door and a rotary axis of the second door extends in parallel to each other.

12. The refrigerator according to claim 11, wherein the rotary axes of the first and second doors are perpendicular to a ground, and the first door and the second door are configured to be opened in a same direction.

13. The refrigerator according to claim 12, wherein the locking device is provided at a position of the first door that is laterally opposite to a position at which the rotary axis of the first door is located.

14. The refrigerator according to claim 1, further comprising:

a first door gasket provided at a rear wall of the first door, the first door gasket defining a first closed loop configured to block a leakage of cool air, a second door gasket that is provided at a rear wall of the second door and defines a second closed loop configured to block the leakage of cool air, wherein the moving member is located outside the first closed loop, and wherein the catching part is located outside the second closed loop.

15. The refrigerator according to claim 14, wherein the moving member is configured to, based on the first door coming into contact with the main body, be pushed by the main body and move toward a front of the first door, and wherein the catching member is configured to, based on the moving member moving toward the front of the first door, move upward and be released from the catching part.

16. The refrigerator according to claim 1, wherein the first door further includes a decoration trim cover that covers the recess of the decoration trim.

17. The refrigerator according to claim 1, wherein the housing includes:

a lower housing that receives the moving member, the catching member, and the elastic member; and an upper housing coupled to an upper portion of the lower housing.

18. The refrigerator according to claim 1, wherein the moving member includes a push bar and a conversion member connected to the push bar, the conversion member being configured to transmit a displacement of the push bar to the catching member.

19. The refrigerator according to claim 1, wherein the contacting surfaces are inclined with respect to the front surface of the catching member and disposed rearward relative to the front surface of the catching member in the forward-rearward direction.

20. The refrigerator according to claim 1, wherein the catching member is configured to move into the catching part of the second door along a vertical direction, and wherein the protruding part and the surface of the housing extend in the vertical direction.

* * * * *